US007618153B2

(12) United States Patent
O'Hern

(10) Patent No.: US 7,618,153 B2
(45) Date of Patent: Nov. 17, 2009

(54) FLASHLIGHT WITH ROTATABLE HANDLE

(75) Inventor: Adam O'Hern, Cockeysville, MD (US)

(73) Assignee: Black & Decker, Inc., Towson, MD (US)

( * ) Notice: Subject to any disclaimer, the term of this patent is extended or adjusted under 35 U.S.C. 154(b) by 91 days.

(21) Appl. No.: 11/706,276

(22) Filed: Feb. 15, 2007

(65) Prior Publication Data

US 2008/0198588 A1 Aug. 21, 2008

(51) Int. Cl.
*F21L 4/00* (2006.01)

(52) U.S. Cl. ..... 362/197; 362/157

(58) Field of Classification Search ..... 362/197, 362/157

See application file for complete search history.

(56) References Cited

U.S. PATENT DOCUMENTS

| | | | | |
|---|---|---|---|---|
| 1,637,047 | A * | 7/1927 | Moore | 248/341 |
| 4,541,540 | A * | 9/1985 | Gretz et al. | 220/555 |
| 5,019,951 | A * | 5/1991 | Osterhout et al. | 362/191 |
| 5,988,828 | A * | 11/1999 | Prince et al. | 362/191 |
| 6,154,991 | A * | 12/2000 | Duncan et al. | 38/102.2 |
| 6,802,623 | B1 * | 10/2004 | Hsu et al. | 362/199 |
| 2002/0036902 | A1 * | 3/2002 | Lynch et al. | 362/166 |
| 2002/0125857 | A1 * | 9/2002 | Mastaler et al. | 320/112 |
| 2004/0037072 | A1 | 2/2004 | Parsons et al. | |
| 2004/0228120 | A1 * | 11/2004 | Ross | 362/110 |
| 2006/0209533 | A1 | 9/2006 | Druzin | |

FOREIGN PATENT DOCUMENTS

WO WO 02/25166 3/2002

OTHER PUBLICATIONS http://www.amazon.com/Dewalt-DC527-Heavy-Duty-18-Volt-Fluorescent/dp/B000BANMXG/sr=8-1/qid=1171554038/ref=pd_bbs_sr_1/105-9189620-7573250?ie=UTF8&s=hi.

* cited by examiner

*Primary Examiner*—Jong-Suk (James) Lee
*Assistant Examiner*—Julie A Shallenberger
(74) *Attorney, Agent, or Firm*—Kramer & Amado, P.C.

(57) ABSTRACT

A portable flashlight includes a housing having a first end, a second end, a base, and an axis running from the first end to the second end of the housing. A rechargeable battery is connected to the base of the housing, so that the battery may be used as a stand for the battery. In the first end of the flashlight, a parabolic reflector having a focus is positioned, so that the focus of the reflector is positioned on the axis of the housing. A fixture or socket for holding an electric light is positioned so as to hold the light at the focus of the reflector. A handle is connected to the housing, where the handle has a first end and a second end. An elastic cord runs from the first end of said handle to the second end of the handle; and one end of the elastic cord may be released from the handle, wrapped around a support for the flashlight, and reattached to the handle. The handle may be rotated relative to the axis of the housing.

32 Claims, 10 Drawing Sheets

FLASHLIGHT WITH ROTATABLE HANDLE

BACKGROUND

1. Field

The subject matter disclosed herein generally relates to flashlights or portable spotlights with rechargeable batteries. In various preferred embodiments, the flashlights or portable spotlights may be handheld, or may be releasably secured to a convenient support.

2. Description of the Prior Art

Flashlights and portable spotlights in the prior art frequently, include a tubular body with a light positioned at one end. The tubular body is sized so that it may be conveniently grasped by a user. Flashlights of such a design have the disadvantage that they cannot conveniently be placed on a planar support surface for directing the beam in a desired direction. This is because the tubular body is subject to rolling on the planar surface. Other flashlights and portable spotlights in the prior art include a handle for grasping by the user. The utility of these types of prior art spotlights is limited, however, in that they typically do not include a base with legs or a planar lower surface, and therefore are not self supporting. That is to say, such lights cannot be placed on a support planar support surface. Other prior art spotlights can be coupled with a tripod, such as that used for cameras or surveying equipment, but such tripods are bulky and inconvenient to use.

In some cases where a user needs a portable spotlight or flashlight, he is performing a task which requires the use of two hands. Planar supports for a portable spotlight or flashlight are frequently unavailable in such circumstances. In such cases, it would be convenient to suspend the flashlight from an elevated support, such as a rafter, a joist, a tree branch, or a loop on the inside of a car hood. Most prior art flashlights lack a mechanism for easily suspending the light from an elevated support or beam where a planar support surface is unavailable.

It is common that a portable light is needed in a situation where a task requiring use of two hands is performed. It is an object of various exemplary embodiments disclosed herein to provide a portable light which may be conveniently supported on a planar surface in a stable manner.

It is an object of various exemplary embodiments disclosed herein to provide a portable light which may be conveniently suspended from an elevated support.

The foregoing objects and advantages of the exemplary embodiments disclosed herein are illustrative of those that can be achieved by the various exemplary embodiments and are not intended to be exhaustive or limiting of the possible advantages which can be realized. Thus, these and other objects and advantages of the various exemplary embodiments will be apparent from the description herein or can be learned from practicing the various exemplary embodiments, both as embodied herein or as modified in view of any variation which may be apparent to those skilled in the art. Accordingly, the present invention resides in the novel methods, arrangements, combinations and improvements herein shown and described in various exemplary embodiments.

SUMMARY

In light of the present need for flashlights and, a brief summary of various exemplary embodiments is presented. Some simplifications and omission may be made in the following summary, which is intended to highlight and introduce some aspects of the various exemplary embodiments, but not to limit its scope. Detailed descriptions of a preferred exemplary embodiment adequate to allow those of ordinary skill in the art to make and use the disclosed concepts will follow in later sections.

In various exemplary embodiments, a portable light includes a housing having a first end, a second end, and an axis running from the first end to the second end of the housing. In various exemplary embodiments, a rechargeable battery is connected to a base of the housing, so that a lower surface of the battery may be used as a stand for the battery. In various exemplary embodiments, an electric power source is positioned within the housing. This electric power source positioned within the housing may be a removable battery or batteries, or an electric power source which may be connect to a household power supply by an electric cord running from the housing. In the first end of the flashlight, a parabolic reflector having a focus is positioned, so that the focus of the reflector is positioned on the axis of the housing. A fixture or socket for holding an electric light is positioned so as to hold the light at the focus of the reflector.

A handle is connected to the housing, where the handle has a first end and a second end. An elastic cord runs from the first end of said handle to the second end of the handle; and one end of the elastic cord may be released from the handle, wrapped around a support for the flashlight, and reattached to the handle. The handle may be rotated relative to the axis of the housing. A control selectively allows free rotation of the handle about the axis of the housing, or rotationally fixes the handle in a specified orientation, relative to the housing.

Further areas of applicability of the various exemplary embodiments of the portable light described herein will become apparent from the detailed description provided hereinafter. It should be understood that the detailed description and specific examples, while indicating various exemplary embodiments of the flashlight, are intended for purposes of illustration only and are not intended to limit the scope of the invention. Further, the following description and accompanying drawings provide multiple features and embodiments that are usable together, but may be shown separately to avoid prolixity and facilitate ease of understanding.

BRIEF DESCRIPTION OF THE DRAWINGS

In order to better understand various exemplary embodiments, reference is made to the accompanying drawings, wherein.

DETAILED DESCRIPTION OF THE PREFERRED EMBODIMENTS

Figure 1:
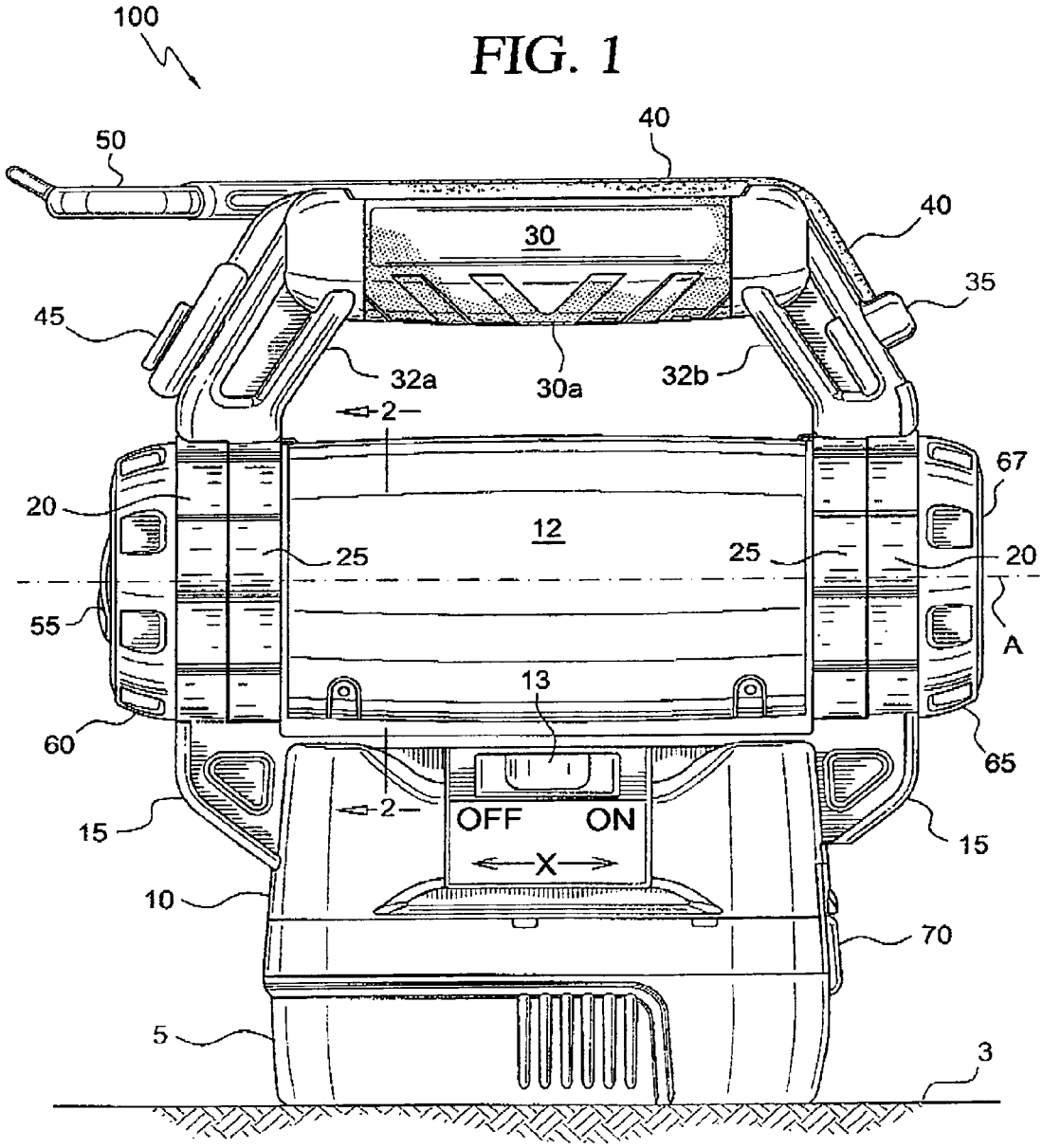
FIG. 1 shows a side view of a first exemplary embodiment of the flashlight disclosed herein, including handle 30 with elastic cord 40 attached thereto.

Referring now to the drawings, in which like numerals refer to like components or steps, there are disclosed broad aspects of various exemplary embodiments. FIG. 1 is a side view showing features of various exemplary embodiments of the flashlight disclosed herein. In various exemplary embodiments, flashlight 100 includes a rechargeable battery 5 which is releasably attached to base 10 of the flashlight 100, where base 10 has a substantially planar bottom surface. Battery 5 has a planar bottom surface which may be used to rest flashlight 100 on a planar surface 3. Tubular flashlight housing 12 is mounted on base 10 by at least one support 15. In various exemplary embodiments, supports 15 are each mounted to one of two rings 20. In various exemplary embodiments, a single support 15 may be directly mounted to housing 12. Rings 20 each surround one end of housing 12, and are non-rotatably mounted to housing 12 so as to hold housing 12 in an orientation such that an axis A of housing 12 is substantially parallel to the planar bottom surface of base 10. A flashlight actuator 13 which slides reversibly in the direction of arrow X between a first "ON" position and a second "OFF" position is mounted on base 10. Battery 5 has a substantially flat bottom surface which may be placed on a planer support for the flashlight, such as a table or workbench.

In various exemplary embodiments, rings 25 rotatably surround opposite ends of housing 12, adjacent to non-rotatable rings 20. A handle 30 is connected to the rotatably mounted rings 25; handle 30 may have a rubberized or high-friction non-skid gripping surface or coating 30*a*. Handle 30 is substantially parallel to axis A. In various exemplary embodiments, a first end of handle 30 is connected to a first ring 25 by means of a first connector 32*a*, and a second end of handle 30 is connected to a second ring 25 by means of a second connector 32*b*. A clamp 35 mounted on connector 32*b* holds one end of an elastic cord 40. The elastomeric cord may be made of rubber or may be a bungee cord. The elasticity of the elastic cord 40 is selected so that suspension of a mass equal to that of flashlight 100 from cord 40 will produce an elongation of from 25% to 300%, preferably from 30% to 200%, more preferably from 35% to 150%. The other end of elastic cord 40 ends in a rubber loop 50. Elastic cord 40 is stretched from the clamp 35 longitudinally along a groove 31 in handle 30, and then fits over hook 45. If desired, cord 40 may be readily disengaged from hook 45 by pulling loop 50 free of hook 45.

Upon disengagement of cord 40 from hook 45, the elastic cord 40 may be wrapped around a non-planar support, such as a rafter, an exposed wall joist, a tree or a tree branch, a pole, or a loop on the inside of a car hood. Cord 40 may then be reattached to hook 45, and the flashlight may be left suspended from the non-planar support. This allows the user adequate lighting while doing work that requires the use of two hands.

Figure 2A:
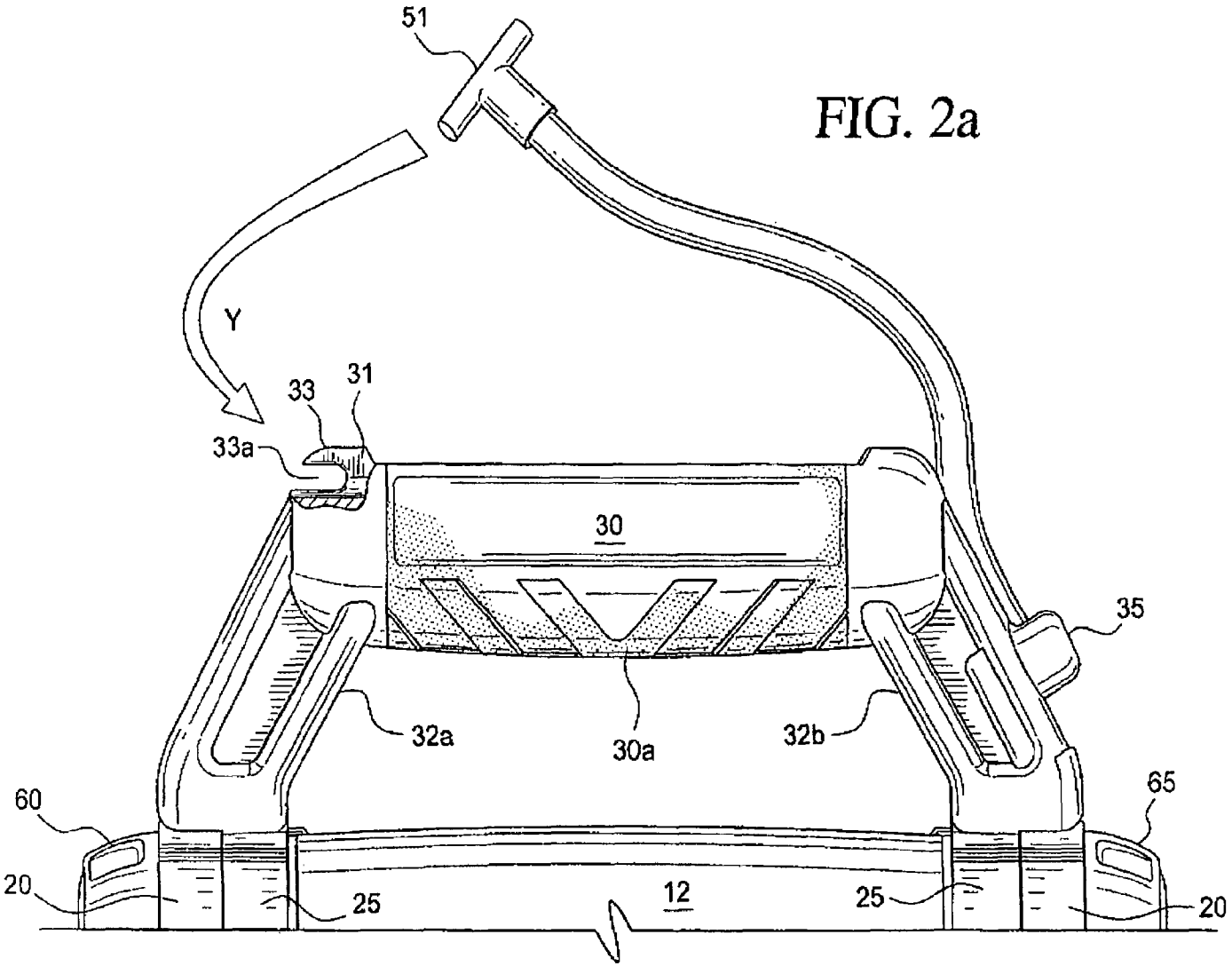
FIGS. 2*a*, 2*b*, and 2*c* show various exemplary embodiments of methods of attaching cord 40 to handle 30 in the flashlight of FIG. 1.

In various exemplary embodiments shown in FIG. 2*a*, the elastic cord 40 fits into a longitudinal groove 31 having opposing walls 33 running from a first end of the handle 30 to the second end of the handle. The elastic cord 40 is secured to one end of handle 30 by means of clamp 35. A T-hook 51 may replace loop 50 on the second end of the elastic cord 40. T-hook 51 fits into a pair of slots 33*a* in the opposing walls 33 of the longitudinal groove 31 as shown by arrow Y, thereby securing the elastic cord 40 to the other end of handle 30. If desired, cord 40 may be readily disengaged from slots 33*a* by pulling T-hook 51 free of slots 33*a*.

Figure 2C:
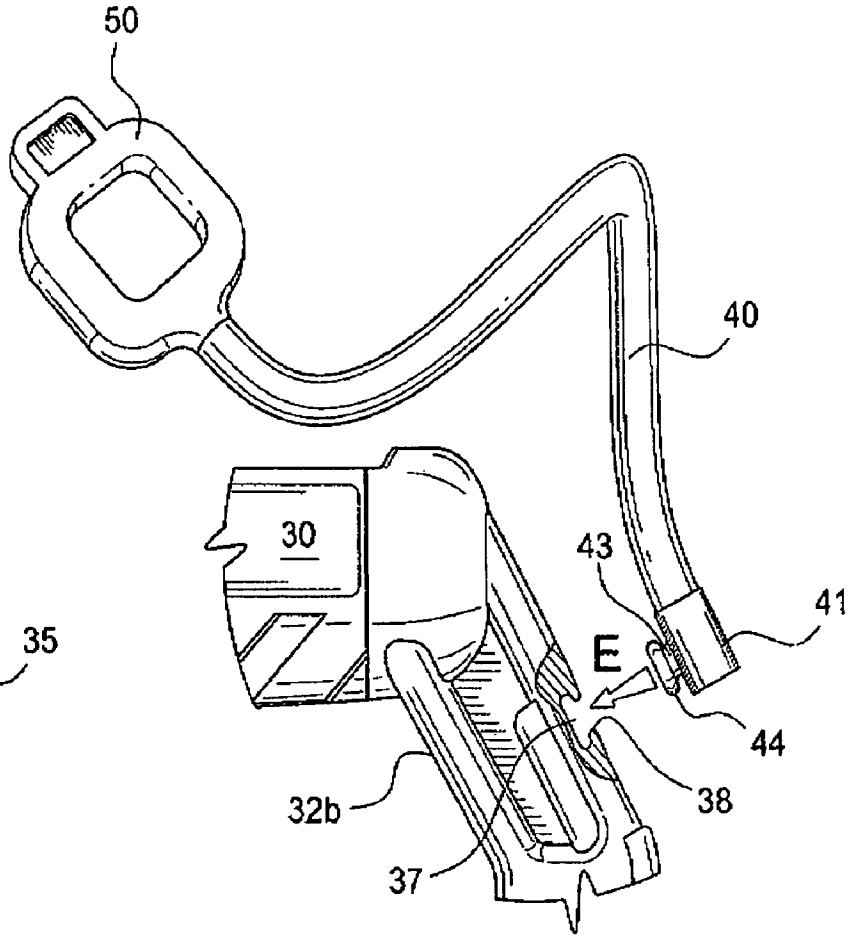
Figure 2B:
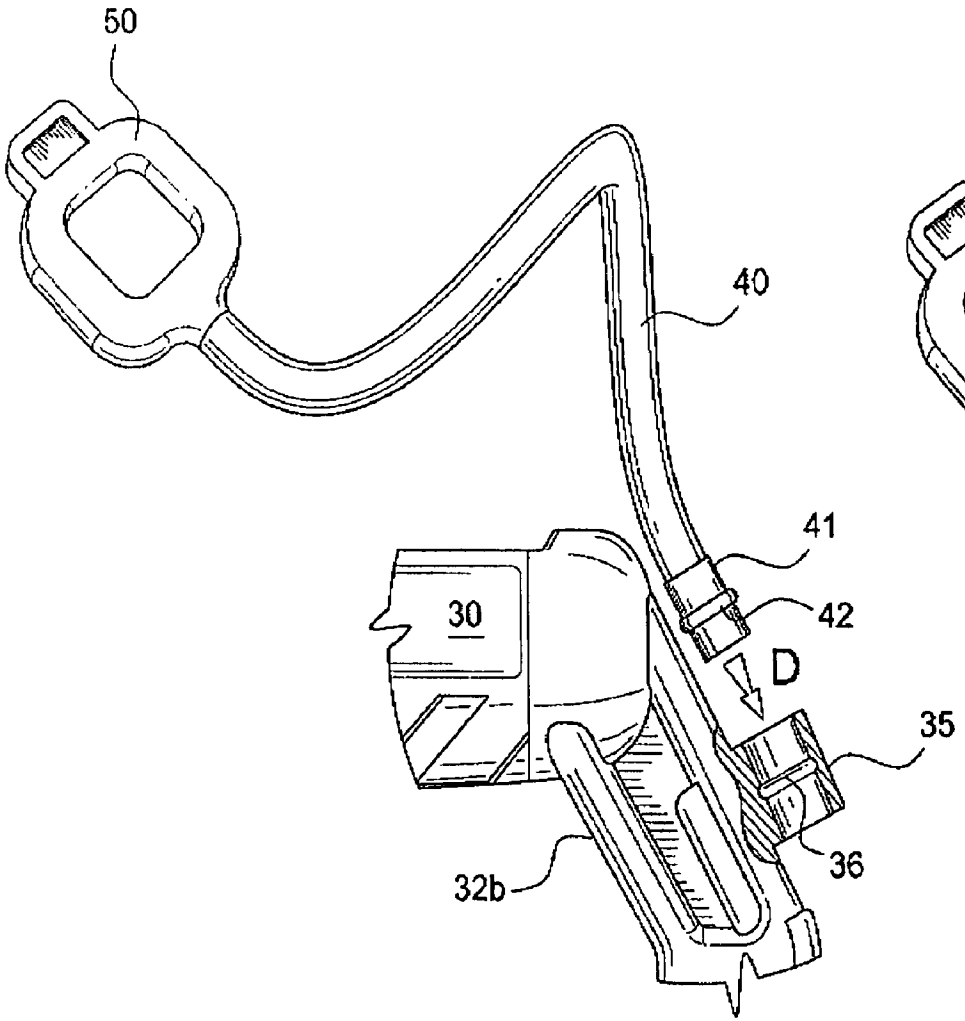

In various exemplary embodiments, cord 40 includes an end cap member 41 at the end opposite loop 50, as shown in FIG. 2*b*. End cap 41 has a ridge 42 about its circumference. End cap 41 slides into clamp 35 in the direction of arrow D until ridge 42 engages a slot 36 on the inner surface of clamp 35. End cap 41 is held in position by clamp 36 until application of force to cap 41 causes ridge 42 to disengage from slot 36, allowing end cap 41 to slide out of clamp 35.

In various exemplary embodiments, clamp 35 on handle connector 32 may be replaced by a female joint 37 having a ridge 38 on its inner surface. In such embodiments, cord 40 includes an end cap member 41 having a male joint 43, as shown in FIG. 2*c*. Male joint 43 of end cap 41 has a ridge 44 about its circumference. Male joint 43 snaps onto connector 32 by sliding joint 43 into female joint 37 in the direction of arrow E until ridge 44 passes ridge 38. End cap 41 is held in position until application of force to cap 41 causes joint 43 to disengage from female joint 37, allowing end cap 41 to slide out of clamp 35.

Returning to FIG. 1, cap 65 seals a first end of housing 12. Cap 65 contains a glass or clear plastic lens 67 which covers a light bulb (not shown in FIG. 1). Cap 65 may be unscrewed from housing 12 so as to allow the light bulb to be changed. Cap 60 seals a second end of housing 12, where the second end of housing 12 is opposite the light bulb for the flashlight. Control switch 55 in cap 60 controls rotation of rings 25. In a first position, switch 55 allows free rotation of rings 25 and handle 30 attached thereto about the axis A of housing 12 in various exemplary embodiments. In a second position, switch 55 locks rings 25 and handle 30 attached thereto into a fixed orientation relative housing 12.

Figure 3B:
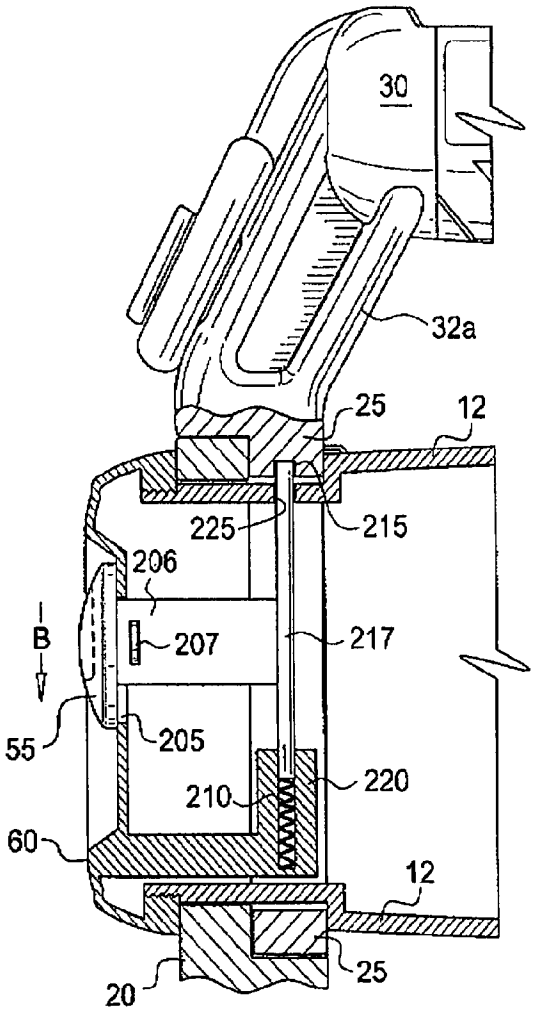
FIGS. 3*a* and 3*b* are cross sectional views of the flashlight disclosed herein, showing a mechanism for controlling rotation of handle 30 about an axis of the flashlight.
Figure 3A:
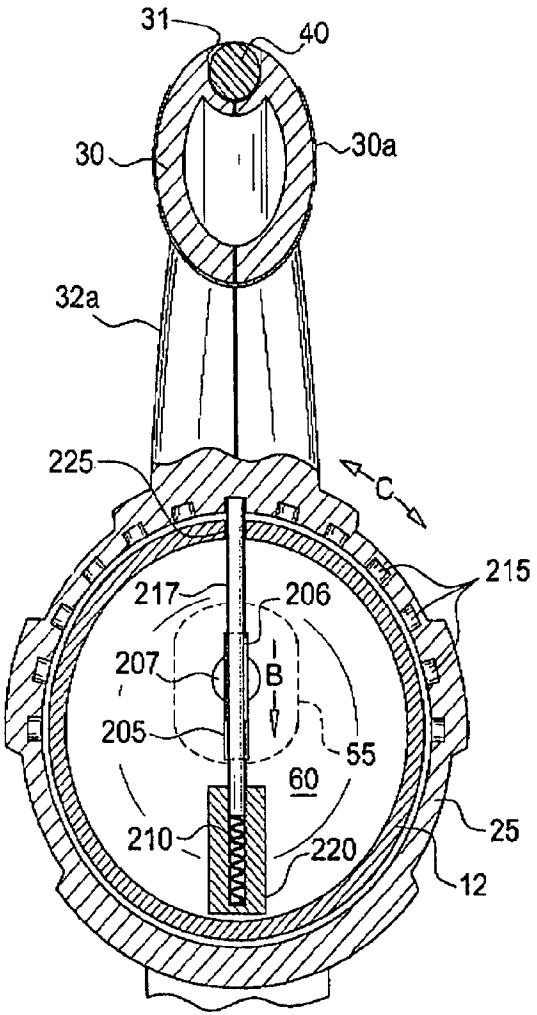

FIGS. 3*a* and 3*b* show the operation of switch 55 in further detail. FIG. 3*a* shows a cross section of the embodiment of FIG. 1, viewed along axis A of housing 12, in the direction of arrows 2. Rotatable ring 25 encircles the tubular wall of housing 12; the interior surface of cap 60 is seen closing the end of housing 12. On the opposite side of cap 60 is switch 55 (shown in outline in FIG. 3*a*). Connector 32*a* and handle 30 are connected to the exterior surface of ring 25. On the interior surface of ring 25 are a plurality of holes or notches 215. When handle 30 is oriented in a vertical position, a central notch 215 is in an uppermost position, oriented at 0° relative to the vertical direction. On each side of the central notch 215, additional notches 215 are oriented at between 15° and 90° relative to the vertical direction, in 15° increments.

Switch 55, which is more clearly seen in FIG. 3*b*, is movably supported on cap 60. A slot 205 passes through cap 60. A generally planar tab 206 which is substantially parallel to the axis of housing 12 passes movably through slot 205. Planar tabs 207 extending from tab 205 are generally parallel to the interior surface of cap 60, and prevent switch 55 from moving axially relative to housing 12 without precluding radial movement along slot 205. A spring 210 is positioned in a spring receptacle 220, which may be mounted to cap 60 or to an interior wall of housing 12. A pin 217 is connected to tab 206. Pin 217 is biased into a first position by spring 210, as shown in FIG. 3*a*. In this first position, one end of pin 217 is pushed by the pin through hole 225 in the wall of housing 12 and into one of notches 215 on the interior surface of ring 25, thereby precluding movement of ring 25 or the handle attached thereto.

When switch 55 is moved in the direction of arrow B, pin 217 is moved downward against the biasing force of spring 217 into a second position. In this second position, pin 217 does not interact with notches 215, thereby allowing free rotation of ring 25 and the handle attached thereto about the axis of housing 12. Handle 30 may then be rotated from 15° to 90° away from a vertical position in either a clockwise or counterclockwise direction, as shown by arrow C in FIG. 3*a*.

When handle 30 is positioned in a desired orientation, switch 55 is released and spring 210 pushes pin 217 through hole 225 in the wall of housing 12 and into one of notches 215 on the interior surface of ring 25, locking the handle into position.

Figure 4:
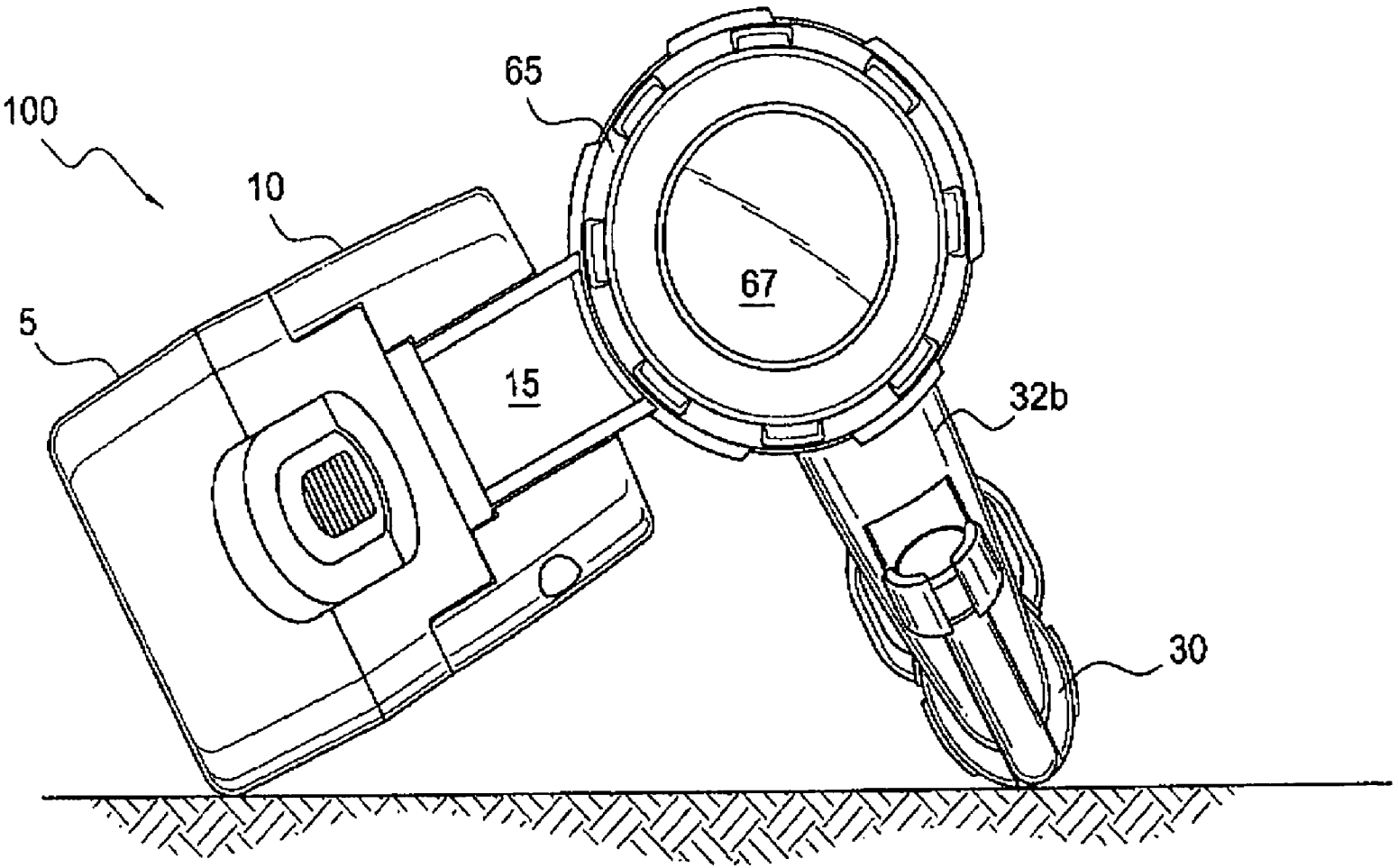
FIG. 4 shows a method of resting an exemplary embodiment of the flashlight disclosed herein on a planar surface.

FIG. 4 shows the flashlight with the handle 30 oriented 90° away a plane which is normal to the plane of the bottom of base 10. The flashlight 100 is here seen resting on a side of battery 5 and handle 30, which here functions as a support or leg. This allows the flashlight to be positioned on a flat surface in a leaning position. The height of the flashlight in this orientation is less than that of the flashlight when it stands on the bottom surface of battery 5. This is particularly convenient if the flat surface is underneath a low overhanging surface, such as a shelf. Such an overhang would prevent the flashlight from resting on that surface in a vertical orientation. The high-friction non-skid outer surface of handle 30 may contact the flat surface, thereby preventing flashlight 100 from sliding along the surface of the flat surface.

Figure 5:
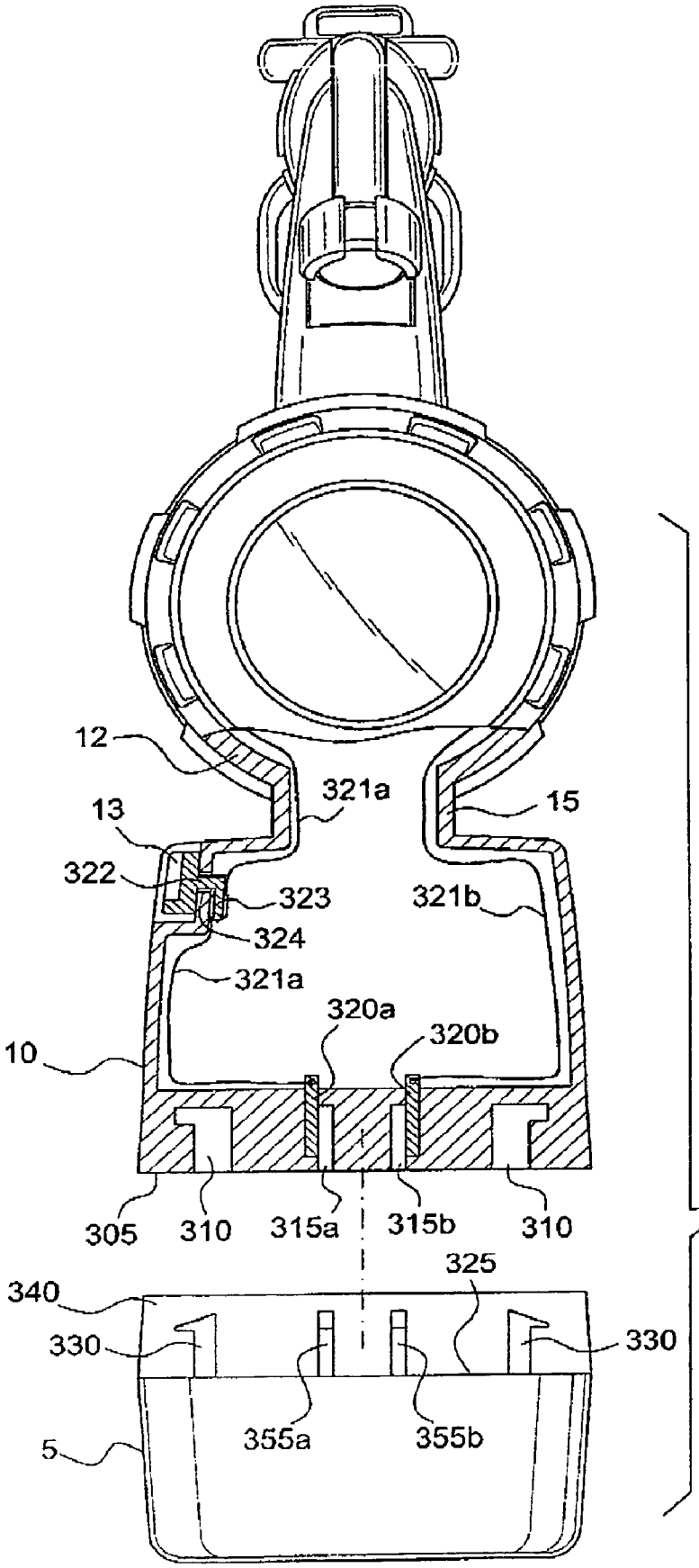
FIGS. 5 and 7 show a method of releasably attaching a power source to an exemplary embodiment of the flashlight disclosed herein.

In various exemplary embodiments, the base 10 has a substantially planar bottom surface 305 as shown in FIG. 5. Longitudinal slots 310 in bottom surface 305 of base 10 have an L-shaped cross section. Longitudinal slot 315*a* in bottom surface 305 of base 10 exposes a side surface of positive terminal 320*a* in base 10. Longitudinal slot 315*b* in bottom surface 305 of base 10 exposes a side surface of negative terminal 320*b* in base 10. Electrical leads 321*a* and 321*b* extend from terminals 320*a* and 320*b*, respectively, and enter housing 12 through a support 15.

Figure 6A:
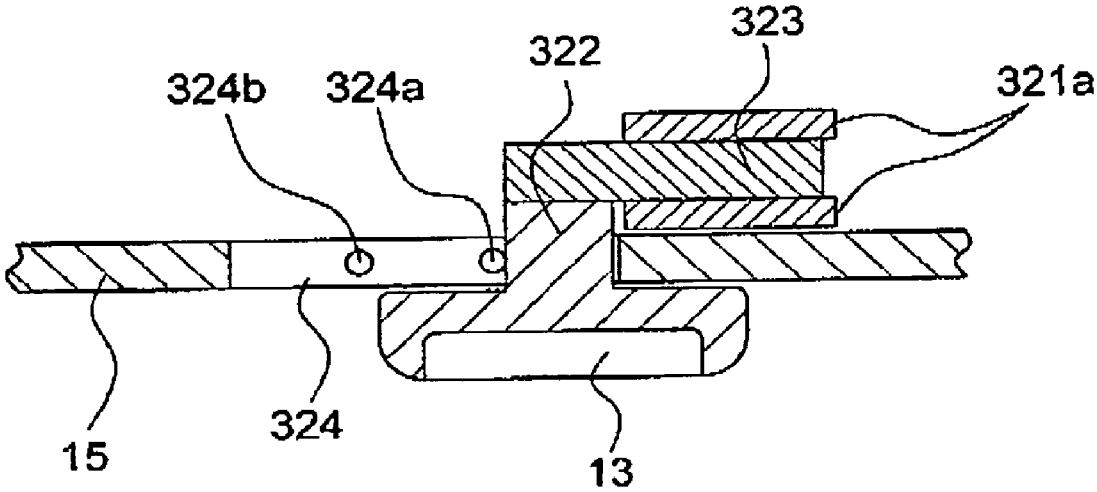
FIGS. 6*a* and 6*b* illustrate the operation of an actuator switch for turning an exemplary embodiment of the flashlight disclosed herein on or off.
Figure 6B:
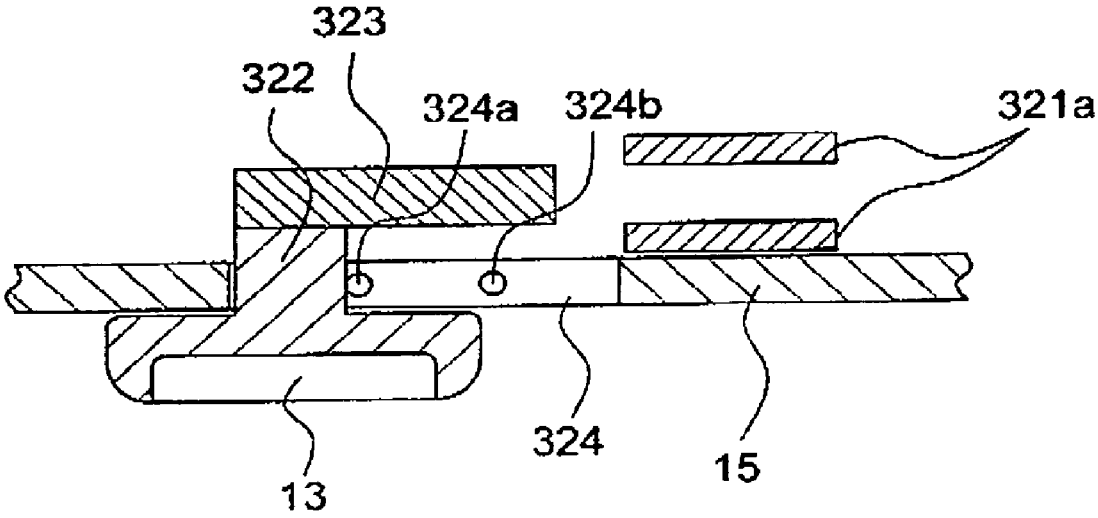

As seen in FIG. 5, there is a gap in lead 321*a*, where this gap is bridged by contact 323. Contact 323 is connected to actuator 13 by post 322, where post 322 slides along slot 324, as shown in FIG. 6*a*. When actuator 13 is in its "ON" position, contact 323 bridges the gap in lead 321*a*. When actuator 13 is in its "OFF" position, contact 323 fails to bridge the gap in lead 321*a*, preventing completion of an electrical circuit, as shown in FIG. 6*b*. One pin 324*a* and one pin 324*b* is positioned on each side of slot 324. The distance between pins 324*a* and the distance between pins 324*a* are each less than the diameter of post 322. Pins 324*a* thus releasably hold actuator 13 in its "ON" position, where contact 323 bridges the gap in lead 321*a*. Pins 324*b*, on the other hand, releasably hold actuator 13 in its "OFF" position, where contact 323 fails to bridge the gap in lead 321*a*.

Battery 5 will now be further described with reference to FIG. 5. In various exemplary embodiments, battery 5 has a substantially planar top surface 325, with L-shaped longitudinal tabs 330 on top surface 325 of battery 5. Blade-shaped positive and negative terminals 335*a* and 335*b* are positioned on top surface 325 of battery 5. A wall 340 extends vertically from the top surface 325 of battery 5. When the battery 5 is connected to base 10, longitudinal tabs 330 on top surface 325 of battery 5 slide into longitudinal slots 310 in bottom surface 305 of base 10 until a rear surface of base 10 contacts wall 340. At this point, the base is locked into position relative to the battery by a mechanism which will be further described later. At the same time that tabs 330 slide into slots 310, positive and negative terminals 335*a* and 335*b* on top surface 325 of battery 5 slide into slots 315*a* and 315*b* on housing 10, respectively. This allows positive terminal 335*a* to contact positive terminal 320*a*, and negative terminal 335*b* to contact negative terminal 320*b*.

Figure 7:
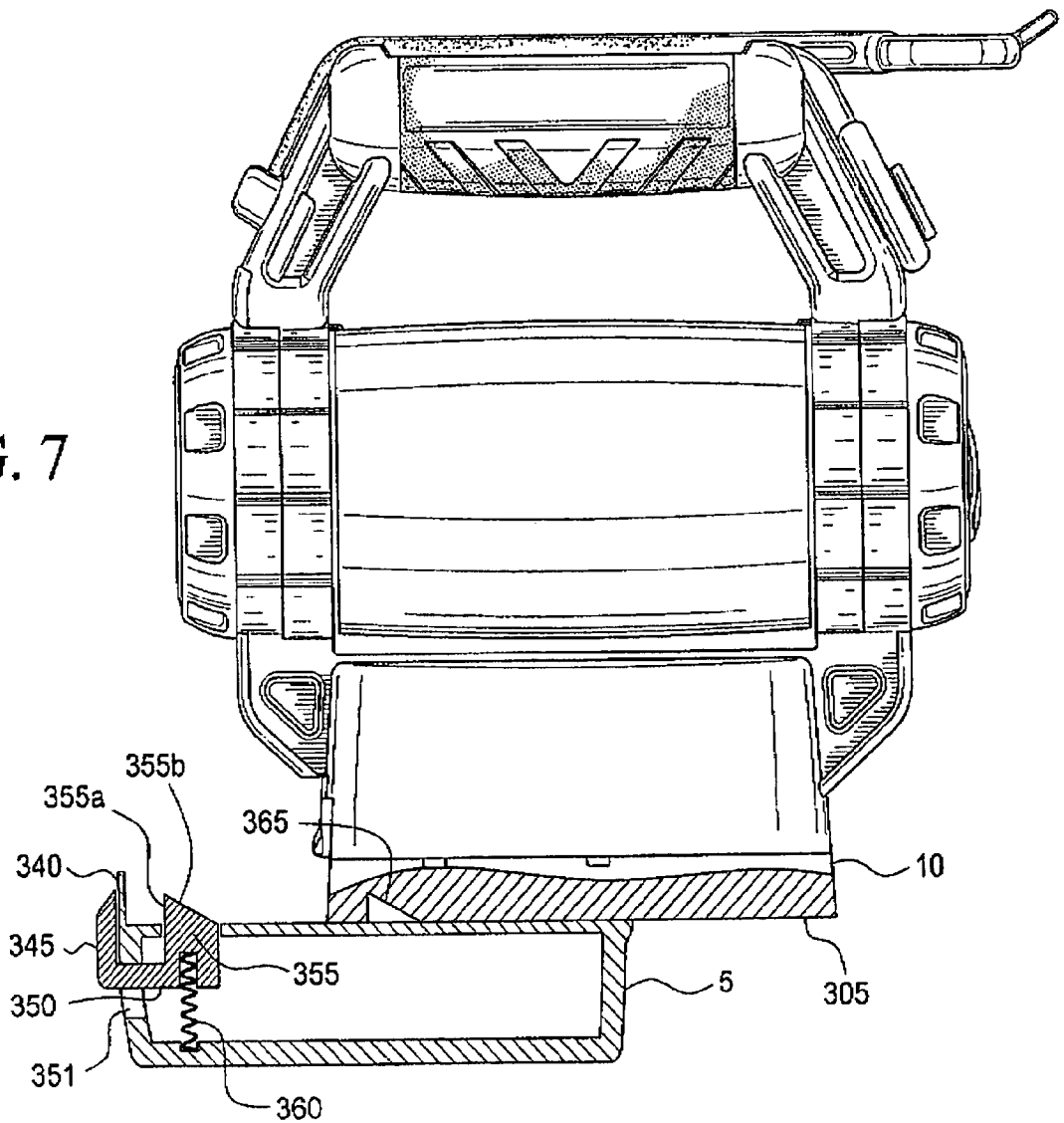

A mechanism for locking base 10 into position relative to battery 5 will now be described. In various exemplary embodiments, battery 5 includes switch 345 on the rear surface of wall 340, as shown in FIG. 7 (Note that electrodes 335*a* and 335*b* and tabs 330 have been omitted for clarity). A strut 350 extending from switch 345 through slot 351 supports a wedge-shaped member 355. A rear surface 355*a* of wedge-shaped member 355 is parallel to the wall 340, while a front surface 355*b* of wedge-shaped member 355 makes an angle of from 30° to 45° with the top surface 325 of battery 5. When switch 345 is in a first position, wedge-shaped member 355 is exposed above the top surface 325 of battery 5. When switch 345 is in a second position, wedge-shaped member 355 is below the top surface 325 of battery 5. A spring 360 biases the switch into the first position. In various exemplary embodiments, bottom surface 305 of base 10 includes a wedge-shaped hole 365 adapted to receive wedge-shaped member 355.

When the battery 5 is connected to base 10 as described above, the rear surface of base 10 contacts sloped surface 355*b* of member 355. As the rear surface of base 10 slides along the upper surface of battery 5, member 355 is pushed downwards by base 10, compressing spring 360. When base 10 contacts wall 340, wedge-shaped hole 365 is positioned above wedge-shaped member 355. Spring 360 then pushes wedge-shaped member 355 upwards, into wedge-shaped hole 365. The base is then locked into position, unable to move against the vertical surface of wall 340 or against vertical rear surface 355*a* of wedge-shaped member 355.

The base 10 may be readily released from battery 5 by moving switch 345 into its second position, causing wedge-shaped member 355 to retract beneath the top surface 325 of battery 5. Base 10 will then readily slide off of battery 5.

Figure 8:
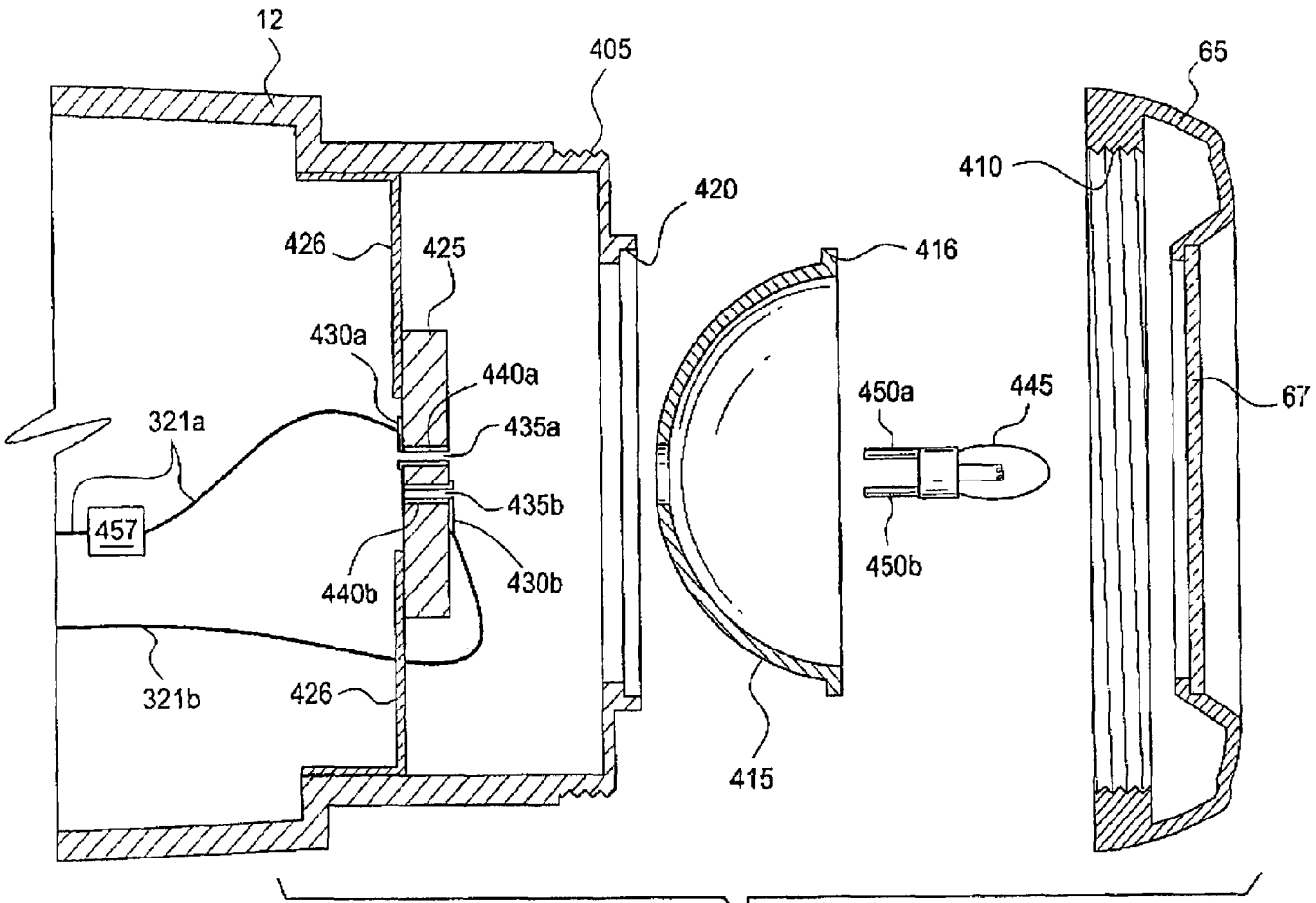
FIGS. 8, 9, and 10 show various exemplary embodiments of the internal components of the flashlight disclosed herein.

FIG. 8 is an exploded cross sectional view of housing 12, showing the components therein. At a first end of housing 12, there is a threaded male joint 405 on the external surface of housing 12. Cap 65 holds a glass or clear plastic lens 67, and has a threaded female joint 410 on its internal surface. Cap 65 may thus be removably screwed onto housing 12. Inside the first end of housing 12, a parabolic reflector 415 is mounted. A lip 416 on reflector 415 fits into a slot 420 on the interior surface of housing 12.

Figure 9:
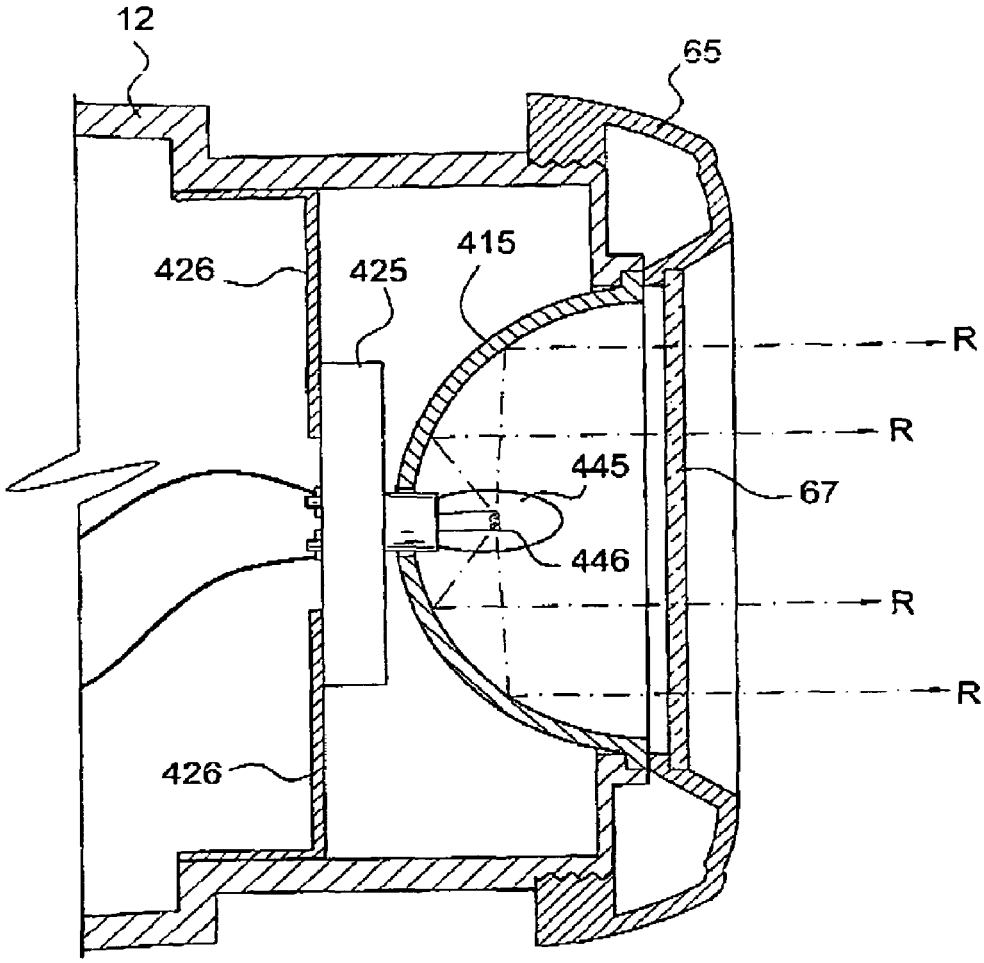

In various exemplary embodiments, a circuit board 425 is mounted in housing 12 behind reflector 415 on supports 426. Circuit board 425 has a positive electrode 430*a* on one side, and a negative electrode 430*b* on the other. Electrical leads 321*a* and 321*b* enter housing 12, and electrical leads 321*a* and 321*b* are connected to positive electrode 430*a* and negative electrode 430*b*, respectively. In various exemplary embodiments, circuit board 425 has a hole 435*a* therethrough, where a conductive metal layer 440*a* on the interior surface of hole 435*a* makes electrical contact with electrode 430*a*. Similarly, circuit board 425 has a hole 435*b* therethrough, where a conductive metal layer 440*b* on the interior surface of hole 435*b* makes electrical contact with electrode 430*b*. A light bulb 445 with a positive pin electrode 450*a* and a negative pin electrode 450*b* is inserted through a hole in the center of reflector 415 so that pin electrode 450*a* enters hole 435*a*, making electrical contact with electrode 430*a*, and pin electrode 450*b* enters hole 435*b*, making electrical contact with electrode 430*b*. Current may then flow through a conductive element 446 in bulb 445. As seen in FIG. 9, the conductive element 446 of bulb 445 is positioned at the focus of reflector 415. Light from conductive element 446 is reflected off of reflector 415 in the direction of arrows R. For reasons of clarity, electrodes are omitted from FIG. 9. Light bulb 445 may be an incandescent light bulb, or a fluorescent gas-discharge bulb, such as a U-tube light bulb.

If a gas-discharge bulb is used, conductive element 446 is a gas or plasma containing a noble gas and mercury, sodium, or metal halides. Gas-discharge bulbs are negative-resistance devices. A ballast 457 must therefore be connected inn series with the circuit board and the gaseous conductive element 446 in the light bulb to provide positive resistance to the flashlight; ballast 457 may be a resistor or an inductor, as shown in FIG. 8. Ballast 457 may be incorporated into the flashlight, or into bulb 445. If bulb 445 contains a ballast, or if bulb 445 is an incandescent bulb, it is unnecessary to incorporate a ballast 457 into flashlight housing 12.

Figure 10:
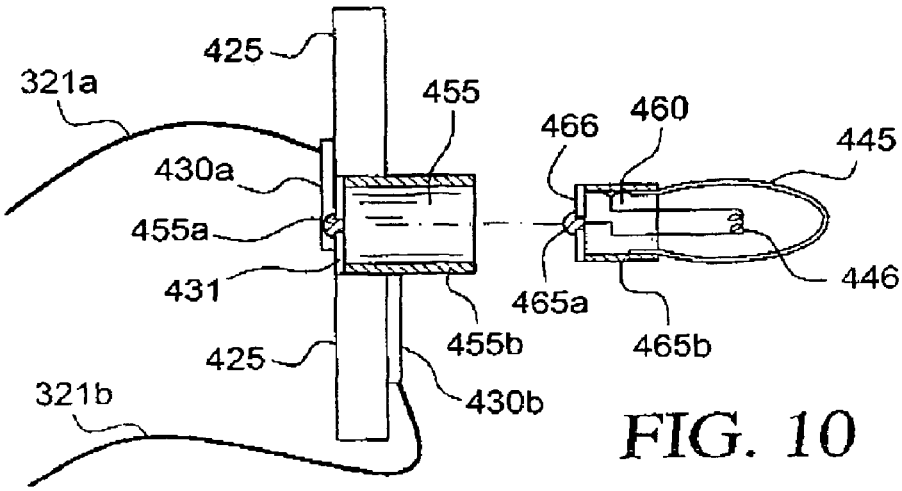

In various exemplary embodiments, circuit board 425 may incorporate a socket for receiving a light bulb with a mole joint, rather than holes for pin electrodes. As shown in FIG. 10, circuit board 425 has a positive electrode 430*a* on one side, and a negative electrode 430*b* on the other. Leads 321*a* and 321*b* contact electrodes 430*a* and 430*b*, respectively. A socket 455 adapted to receive a male joint 460 on a light bulb 445 passes through circuit board 425. A cylindrical wall 455*b* of the socket is metal, and makes electrical contact with negative electrode 430*b*. A metal button electrode 455*a* on a closed end of socket 455 makes electrical contact with positive electrode 430*a*. Electrodes 455*a* and 455*b* are electrically insulated from each other by dielectric plate 431. A circuit is completed when male joint 460 on light bulb 445 is inserted into socket 455. An electrode 465*b* on the outer surface of joint 460 makes electrical contact with cylindrical wall 455*b* of the socket 455, and a button electrode 465*a* on the end of joint 460 makes electrical contact with button electrode 455*a*. Electrodes 465*a* and 465*b* are electrically insulated from each other by dielectric plate 466. Current may then flow through a conductive element 446 in bulb 445.

Although the various exemplary embodiments have been described in detail with particular reference to certain exemplary aspects thereof, it should be understood that the invention is capable of other different embodiments, and its details are capable of modifications in various obvious respects. As is readily apparent to those skilled in the art, variations and modifications can be affected while remaining within the spirit and scope of the invention. Accordingly, the foregoing disclosure, description, and figures are for illustrative purposes only, and do not in any way limit the invention, which is defined only by the claims.

What is claimed is:

1. A portable light, comprising:

a housing having a first end and a second end and a longitudinal axis running from said first end to said second end;

an electric light supported by said housing;

a handle having a first end and a second end, said first end of said handle being rotatably coupled to said first end of said housing and said second end of said handle being rotatably coupled to said second end of said housing, to be freely rotatable about said housing along a circular path centered at the longitudinal axis, wherein the handle includes a groove extending between said first and second ends;

an elastic cord having a first end connected to a first connector secured to the first end of said handle and a second end releasably connected to a second connector connected with the second end of said handle, wherein the elastic cord has an elasticity maintaining the elastic cord within said groove when said second end is connected; and a source of power electrically connected to said electric light.

2. The portable light of claim 1, wherein said first connector is displaced from said second connector along said handle in a direction parallel to said axis.

3. The portable light of claim 1, wherein said source of power is a rechargeable battery.

4. The portable light of claim 1, wherein the grove has opposing walls and further comprising a pair of slots in the opposing walls, and wherein the elastic cord is releasably secured to the second end of said handle by means of a T-hook on the second end of the elastic cord which fits into said pair of slots.

5. The portable light of claim 1, wherein the elastic cord is releasably secured to the second end of said handle by means of a loop on the second end of the elastic cord which fits over a hook connected with the second end of the handle.

6. The portable light of claim 1, wherein the elastic cord is adapted to secure the portable light to a support member by allowing said support member to pass between said handle and said elastic cord.

7. A portable light, comprising:

a housing having a first end, a second end, and an axis running from said first end to said second end;

an electric light supported by the housing;

a handle having a first end, a second end, wherein said first end of said handle is connected with said first end of said housing and said second end of said handle is connected with said second end of said housing;

an elastic cord having a first end connected to a first connector and a second end releasably connected to a second connector, each of said first and second connectors being connected with said handle; and a source of power electrically connected to said electric light, wherein said first end of said handle is rotatably connected with the first end of said housing by a coupling member rotatable about said axis and wherein the second end of said handle is rotatably connected with the second end of said housing by a coupling member rotatable about said axis, wherein the handle is movable relative to said housing to desired orientations along a circular path centered at said axis.

8. The portable light of claim 7, further comprising a control having a member selectably movable between a release position and a fixing position, the member in the release position allowing free rotation of said handle along said circular path about said axis, and the member in the fixing position rotationally fixing said handle in a desired orientation along said circular path, relative to said housing.

9. The portable light of claim 1, wherein said housing further includes a base; and wherein said source of power is releasably secured to said base of said housing.

10. The portable light of claim 9, wherein said source of power is a rechargeable battery having an upper surface with positive and negative terminals that contact positive and negative terminals in the base of the housing.

11. The portable light of claim 10, wherein L-shaped longitudinal tabs on the upper surface of said rechargeable battery are slidably received by cooperating L-shaped slots in said base of said housing.

12. The portable light of claim 10, wherein at least one of said rechargeable battery and said base of said housing further comprises a locking mechanism for releasably securing said rechargeable battery to said base of said housing.

13. The portable light of claim 10, wherein said rechargeable battery has a planar lower surface that is adapted to rest on a planar support.

14. A portable light, comprising:

a housing having a first end, a second end opposite said first end, and a longitudinal axis running from said first end to said second end;

an electric light supported by said housing;

a handle having a first end and a second end, said first end of said handle being rotatably coupled to said first end of said housing and said second end of said handle being rotatably coupled to said second end of said housing, to be freely rotatable about said housing along a circular path centered at said longitudinal axis;

a control having a member movable between a release position and a fixing position, the member in the release position allowing rotation of said handle, relative to said housing, to a desired position along said circular path about said axis, and the member in the fixing position fixing said handle in a desired position along said circular path; and a source of power electrically connected to said electric light.

15. The portable light of claim 14, further comprising an elastic cord which has a first end and a second end, where said first end is connected with a first connector and said second end is releasably secured to a second connector.

16. The portable light of claim 15, wherein said first connector and said second connector are connected with said handle, said first connector is displaced from said second connector along said handle in a direction parallel to said axis.

17. The portable light of claim 14, wherein said housing further includes a base; and wherein said source of power is releasably secured to said base of said housing.

18. The portable light of claim 17, wherein said source of power is a rechargeable battery having an upper surface with positive and negative terminals in the base of the housing.

19. The portable light of claim 18, wherein said rechargeable battery has a planar lower surface that is adapted to rest on a planar support.

20. The portable light of claim 14, wherein said handle is rotatable between 15° and 90° away from a vertical orientation in either a clockwise or a counterclockwise direction.

21. The portable light of claim 18, wherein said handle is rotatable 90° along said circular path away from a given vertical orientation in either a clockwise or a counterclockwise direction, wherein rotation of said handle by said 90° arranges a surface of said handle and an edge of said battery to lie in a common plan, wherein said surface of said handle serves as a first support for said portable light on an external surface and said edge of said battery serves as a second support for said portable light on said external surface.

22. The portable light of claim 21, wherein said surface of said handle has a high friction non-skid surface.

23. The portable light of claim 18, wherein L-shaped longitudinal tabs on the upper surface of said rechargeable battery are slidably received by cooperating L-shaped slots in said base of said housing.

24. The portable light of claim 23, wherein at least one of said rechargeable battery and said base of said housing further comprises a locking mechanism for releasably securing said rechargeable battery to said base of said housing.

25. A portable light, comprising:

a housing extending along a longitudinal axis and having a first end and a second end opposite from the first end in the direction of the longitudinal axis, and a base having positive and negative electrodes;

a fixture connected to said housing for holding an electric light, said fixture being electrically connected with said positive and negative electrodes;

a handle having a first end and a second end, said first end of said handle being rotatably coupled to said first end of said housing and said second end of said handle being rotatably coupled to said second end of said housing, to be freely rotatable about said housing along a circular path centered at said longitudinal axis;

a control having a member selectably movable between a release position and a fixing position, the member at the release position allowing rotation of said handle along said circular path about said longitudinal axis, and the member at said fixing position fixing said handle in a desired position along said circular path, wherein said base is adapted to receive a power source.

26. The portable light of claim 25, wherein said base is adapted to be releasably secured to a surface of an external battery pack, so that positive and negative terminals on the surface of said external battery pack contact said positive and negative terminals in said base.

27. A portable light, comprising:

a housing extending along a longitudinal axis and having a first end and a second end opposite from the first end in the direction of the longitudinal axis, and a base having positive and negative electrodes;

a fixture connected to said housing for holding an electric light, said fixture being electrically connected with said positive and negative electrodes;

a handle, said handle having a first end and a second end, wherein said first end of said handle is rotatably connected with said first end of said housing by a first coupling member rotatable about said axis and second end of said handle is rotatably connected with said second end of said housing by a second coupling member rotatable about said axis, wherein the handle is movable relative to said housing to different positions along a circular path centered at said longitudinal axis;

a control having a member selectably movable between a release position and a fixing position, the member at the release position allowing rotation of said handle along said circular path about an said longitudinal axis, and wherein the member at said fixing position fixes said handle in a desired position along said circular path; and an elastic cord running from said first end of said handle to said second end of said handle, said elastic cord being releasably connected with said second end of said handle;

wherein said base is adapted to receive a power source.

28. The portable light of claim 1 wherein said light is supported along said axis.

29. The portable light of claim 7 wherein said light is supported along said axis.

30. The portable light of claim 14 wherein said light is supported along said longitudinal axis.

31. The portable light of claim 25 wherein said light is supported along said longitudinal axis.

32. The portable light of claim 27 wherein said light is supported along said longitudinal axis.

* * * * *